US007672434B2

(12) United States Patent
Saint-Martin et al.

(10) Patent No.: US 7,672,434 B2
(45) Date of Patent: Mar. 2, 2010

(54) X-RAY TUBE

(75) Inventors: Thomas Saint-Martin, Limours (FR); Frederic Dahan, Yvelines (FR); Jean-Luc Josse, Neuilly Plaisance (FR); Harith Vadari, Hyderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/248,057

(22) Filed: Oct. 9, 2008

(65) Prior Publication Data

US 2009/0097616 A1 Apr. 16, 2009

(51) Int. Cl.
*H01J 35/00* (2006.01)

(52) U.S. Cl. ..... 378/132; 378/144

(58) Field of Classification Search ..... 378/119, 378/121, 125, 131, 132, 133, 143, 144
See application file for complete search history.

(56) References Cited

U.S. PATENT DOCUMENTS 7,245,700 B2 * 7/2007 Vadari et al. ..... 378/133

FOREIGN PATENT DOCUMENTS

FR 2 879 809 2/2007

* cited by examiner

*Primary Examiner*—Courtney Thomas
(74) *Attorney, Agent, or Firm*—Global Patent Operation

(57) ABSTRACT

An X-ray tube equipped with a rotating anode cartridge comprising a reinforced sealing system. This sealing system is achieved in three complementary manners. Firstly, when the anode rotates, in order to confine the liquid alloy within the cartridge, the invention provides to equip the two surfaces of a leak-tight joint with grooves thereby obtaining a double sided joint with an improved efficiency. Secondly, the double sided joint makes it possible to obtain, for the vacuum tightness, when the anode shaft is not rotating, two spaces limited by the surface tension of the alloy of liquid metal. The more symmetrical these two spaces, the more the sealing is reinforced. Thirdly, the invention provides to separate the ring from the axis of rotation. This enables a joint centering the two spaces in an automatic and natural manner to be obtained.

10 Claims, 2 Drawing Sheets

X-RAY TUBE

CROSS-REFERENCE TO RELATED APPLICATIONS

This application claims priority under 35 U.S.C. §119(a)-(d) to prior-filed, co-pending French patent application serial number 0758261, filed on Oct. 12, 2007, which is hereby incorporated by reference in its entirety.

BACKGROUND OF THE INVENTION

1. Field of the Invention

The present disclosure relates to an X-ray tube equipped with a rotating anode cartridge comprising a reinforced sealing system. Embodiments of the claimed invention can be applied to special advantage but not exclusively in the field of X-ray tubes of an X-ray imaging system, such as an X-ray tomography or mammography system. Embodiments of the claimed invention may also be used in the field of non-destructive testing, when very powerful X-ray tubes are used.

2. Description of Related Art

In the field of radiology by X-rays, in particular, the X-rays are produced by an electronic tube equipped with an anode in rotation on a shaft. A powerful electric field created between the cathode and the anode enables the electrons emitted by the cathode to strike the anode, generating X-rays. For this emission, the positive polarity is applied to the anode via its shaft, the negative polarity to the cathode. The insulation of the assembly is assured, in particular, by dielectrics or by an enclosure, partially in glass, of the electronic tube.

When the tube is used at high power, the impact of electrons on the anode has the effect of abnormally heating up said anode. If the power is too high, an emitting track of the anode may be damaged, hollowed out with impact holes. To avoid such overheating, the anode can be rotated, so as to present, in front of the flow of electrons, a constantly renewed and always cold surface.

A motor of the tube therefore drives the shaft of the anode freely in a mechanical bearing. This bearing is situated in an anode chamber. The anode chamber is itself formed in a support of the anode. The bearing is maintained on the one hand by the anode support and maintains on the other hand the shaft of the anode.

In practice, the bearing industrially comprises conventional ball bearings, as opposed to rarely used magnetic bearings. The problem posed by rotating anodes stems from the rapid wear of the metal coating on the ball bearings, when the shaft rotates in the bearing. The lifetime is then around one hundred hours, leading to a period of use of the tube of around six months to a year. To overcome this problem, coating the ball bearings by metal, lead or silver in the form of a thin layer has been envisaged.

To reduce this premature wear of the metal layer, the invention also provides to place a lubricating film at the interface between the surfaces of the ball bearings and the shaft, between the bearing and the shaft of the anode. With this aim, a liquid based on gallium, indium and tin is poured inside the chamber. Such a liquid is chosen because it improves the coefficient of friction, it reduces the noise of impacts between the ball bearings and it increases the transfer of heat, due to the heating up of the anode, towards the fixed part, either by convection or by conduction. Other lubricating liquids are not used because they have poor degassing properties.

At present, the power demanded of electronic tubes is increasing with the aim of improving the diagnosis. This increase in power leads to an increase in the weight of the anode, up to six to eight kilograms. Consequently, the effects within the bearing become critical. Moreover, in a use in a tomodensitometer, continuously rotating at two rotations per second, the bearing undergoes an acceleration corresponding to around eight times the force of gravity g. Rotation speeds of three to four rotations per second are expected. Consequently, the lifetime of the bearing, and therefore of the tube, with ball bearings and the liquid, may be limited over time. Indeed, the liquid may lose its properties and therefore its characteristics as the heating and the friction within the bearing continue.

In addition, the use of a rotating anode must be compatible with three principal constraints. Firstly, the rotation of the anode must be as free and as perfect as possible, and simple dynamic balancing solutions must be provided to prevent the tube from vibrating when the anode rotates. Secondly, the anode must be able to be taken to a high electric voltage compared to the cathode (normally, bearings with steel ball bearings are used for this purpose). Thirdly, the heat produced by the impact of the electrons on the anode target and which propagates in the shaft must be evacuated efficiently.

Patent application FR-A-2 879 809 discloses an assembly in which ball bearings are lubricated by a gallium alloy and a sealing device of this assembly. In this assembly, an X-ray tube cartridge comprises an anode shaft fitted with ball bearings within a chamber of a fixed support. Such bearings are well suited to the considerable centrifugal accelerations undergone by the tube when it is fitted in a tomodensitometer.

The anode shaft is immersed in a liquid alloy in the chamber of the cartridge. The chamber is completely filled with this alloy. The document FR-A-2 879 809 provides that the sealing of the chamber is achieved by a sealing joint placed at the shaft outlet. An example of such a sealing joint is illustrated in FIGS. 1 and 2.

In FIGS. 1 and 2, the shaft 10 is maintained in the chamber by bearings. At the outlet 11 of the shaft 10, a receptacle or, in a general manner, an anchoring device, is provided to receive an anode 12. At the outlet 11, the fixed support of the chamber is fitted to a mounting ring 13.

The sealing of such a tube will be achieved in two complementary manners. Firstly, for the vacuum tightness, when the anode shaft 10 is not rotating, a space between an interior diameter of the ring 13 and an exterior diameter of the shaft 10 at the point directly in line with this ring 13 is limited. The limit of this space is fixed by the surface tension of the alloy of liquid gallium, indium, tin metal on the material of the shaft 10 and the ring 13. The ring 13 is intended to be fixed when the shaft 10 rotates.

When the shaft 10 rotates, the pressure of the liquid alloy increases. The alloy tends to escape from the chamber and to contaminate the enclosure of the tube. In this case, to confine it within the chamber, the invention provides to equip the surface of the ring 13, which is in contact or that of the shaft 10 directly in line with the ring 13, with a groove 14 of helix relief shape. The pitch of the helix is oriented so that, for a given direction of rotation of the shaft 10, the helix relief behaves like a scraper in front of the surface that rotates before it. Such a scraper tends to push the alloy back towards the chamber.

However, this type of sealing has disadvantages. Indeed, with this type of sealing joint, any small variation in the space between the interior diameter of the ring 13 and the exterior diameter of the shaft 10 leads to a loss of efficiency. Indeed, the increase in this space leads to a leak of the liquid alloy in the enclosure of the tube. A reduction in this space leads to friction.

DETAILED DESCRIPTION

An aim of embodiments of the invention is to remedy the disadvantages of the techniques disclosed above. To do this, embodiments of the invention propose improving the robustness of such a sealing joint.

The sealing is achieved in an embodiment of the invention in three complementary manners. Firstly, when the shaft rotates, the pressure of the liquid alloy increases. The alloy tends to escape from the chamber and to contaminate the enclosure of the tube. In this case, in order to confine it within the chamber, the invention provides to equip the surface of the ring that is in contact and that of the shaft in the region directly in line with the ring with grooves. These grooves give the liquid alloy a fluid dynamics character, thereby enabling sealing. The invention increases the surface area of the grooves by forming grooves both on the surface of the ring and on that of the shaft, thereby improving the robustness of the sealing.

Secondly, the grooves formed on the surface of the ring and on that of the shaft enable a double-sided joint to be obtained. This double sided joint makes it possible to obtain, for the vacuum tightness, when the anode shaft is not rotating, two spaces limited by the surface tension of the alloy of liquid metal between an interior diameter of the ring and an exterior diameter of the shaft. The advantage of this configuration is to cumulate the effect of the grooves on the two faces of the joint by increasing the surface area of the grooves.

Thirdly, an embodiment of the invention provides to separate the ring from the axis of rotation or the shaft, in order to have a floating ring. The degree of freedom obtained enables a translation of the ring in the axial direction. When the shaft rotates, the ring will be locked by one or several longitudinal cotters. The fact of having a floating ring enables the risk of friction to be eliminated.

Moreover, with this floating ring, the stabilization of the two spaces is achieved in a natural manner. This leads to the creation of less additional heat due to less loss of power.

More precisely, an embodiment of the invention provides an X-ray tube that comprises:

an enclosure; and in the enclosure, a cathode, an anode situated opposite the cathode and rotating on a shaft, and a fixed anode shaft support, wherein the fixed anode shaft support comprises a chamber, wherein the shaft of the anode is maintained in the chamber, wherein the fixed anode shaft support is in the form of a removable cartridge, wherein the chamber of the support is filled with an alloy, wherein the chamber is equipped with a sealing joint at the shaft outlet to prevent the alloy leaking outside of the chamber, wherein the fixed anode shaft support comprises, at the position of an outlet of the anode shaft outside of the fixed anode shaft support, a surface of a ring in contact with a surface attached to the shaft, wherein the surface of the shaft in the region directly in line with the ring comprise grooves, enabling a double sided joint to be obtained, and wherein the fixed anode shaft support comprises, at the location of the two surfaces, two spaces narrower than a natural flow clearance of the alloy due to the surface tension of the alloy.

Embodiments of the invention may comprise one or several of the following characteristics:

the two spaces are symmetrical.

the symmetry of these two spaces is achieved, during the design of the tube, when the ring is fixed to the anode shaft.

the symmetry of these two spaces is obtained in an automatic and natural manner, when the ring is separated from the anode shaft and becomes floating.

the shaft comprises at least one longitudinal cotter capable of locking the floating ring to the shaft, when the anode rotates.

the longitudinal cotter is a metal dowel pin.

the shaft comprises an annular part capable of reinforcing the locking of the floating ring to the anode shaft.

the grooves are helix or spiral relief shape, in which the orientation of the pitch is such that it pushes the alloy towards the chamber, when the anode rotates.

the alloy is a gallium, indium or tin alloy.

the support comprises bearings (27), particularly ball bearings.

BRIEF DESCRIPTION OF DRAWINGS

Embodiments of the invention may best be understood by reference to the following detailed description taken in conjunction with the accompanying drawings. These drawings are provided as an indication only and in no way limit the scope of the invention. The figures show.

DETAILED DESCRIPTION OF EMBODIMENTS OF THE INVENTION

Figure 1:
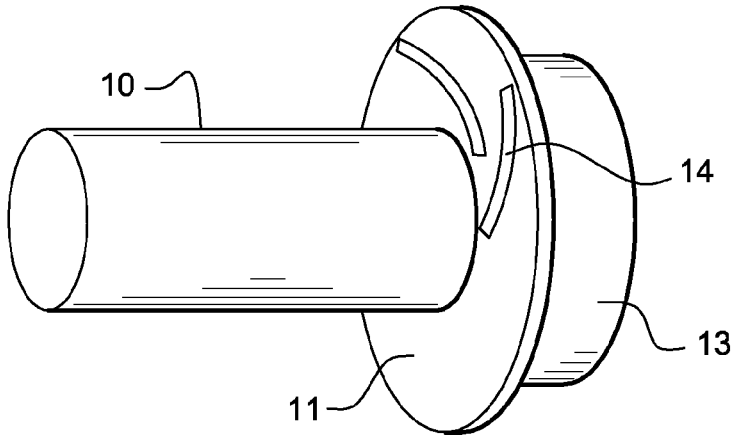
FIG. 1, already described, is a schematic representation of a shaft and a ring of an X-ray tube of the background art.
Figure 2:
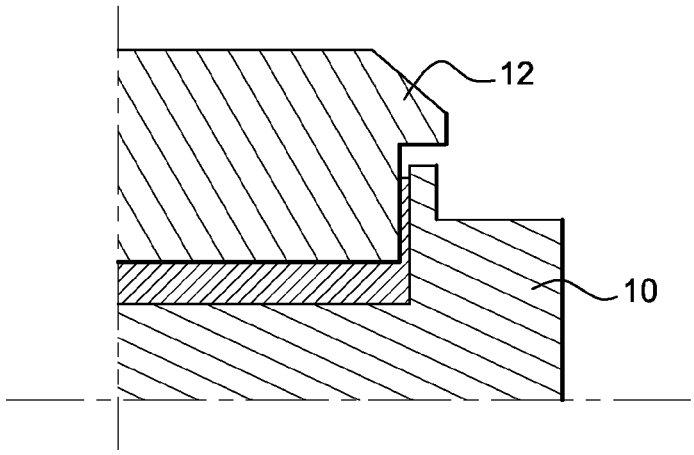
FIG. 2, already described, is a schematic representation of a sectional view of an anode of a tube of the background art.
Figure 3:
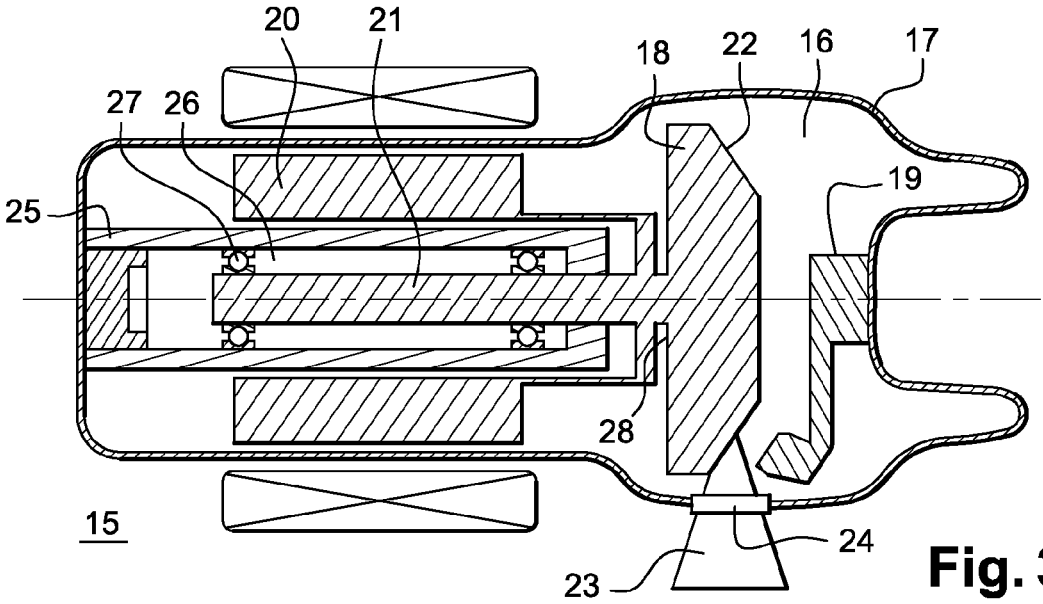
FIG. 3: a schematic representation of a tube comprising the sophisticated means of the invention.

FIG. 3 shows an X-ray tube 15 as set forth in an embodiment of the invention. The tube 15 comprises an enclosure 16. For example, the enclosure 16 is that delimited by a wall 17 of the tube 15. The tube 15 further comprises a rotating anode 18. The rotating anode 18 is located opposite a cathode 19. Inside the enclosure 16 of the tube 15 there is a drive motor 20 that rotates the anode 18. A stator of this motor is located opposite a rotor, outside of the enclosure 16. The anode 18 comprises an anode shaft 21. The cathode 19 is located opposite an anode track 22.

When the anode 18 is supplied with high voltage, electrons are drawn from the cathode 19 and, under the effect of a powerful electric field, strike the anode track 22. Under the effect of this percussion, the anode track 22 constituted of an X-ray emitting material, emits an X-ray 23. The ray 23 exits the tube 15 through a window 24 formed in the wall 17. The window 24 is for example in glass, in a material transparent to X-rays. It is air-tight. The enclosure 16 thus formed is evacuated to form a vacuum in a conventional manner, in particular through an aspiration orifice, not shown, obstructed later by an evacuation pinch off.

To maintain the anode 18 in rotation, the tube 15 is equipped with an anode support 25. This support 25 is hollow and comprises a chamber 26. In the chamber 26, bearings such as 27 assure the anode 18 is maintained by the support 25. These bearings 27 may be ball type bearings. To resolve lubricating and heat conveyance problems from the rotation of the anode 18, it is provided to fill the chamber 26 with a liquid gallium, indium, tin alloy. The shaft 21 is maintained in the chamber 26 by the bearings 27.

Figure 4:
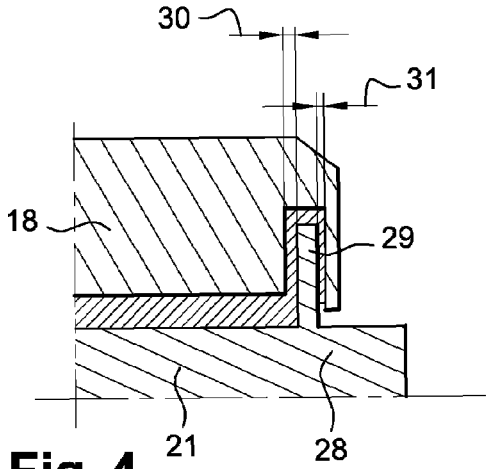
FIG. 4: a schematic representation of a sectional view of an anode and a shaft comprising the sophisticated means of the invention.
Figure 5:
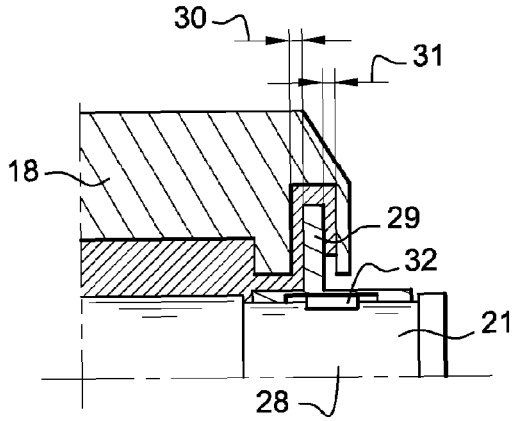
FIG. 5: a schematic representation of a sectional view of an anode and a shaft comprising all of the sophisticated means of the invention.

FIGS. 4 and 5 show in a schematic manner a sectional view of a representation of the anode 18 fitted to the shaft 21 with the sophisticated means of the invention. At the outlet 28 of the shaft 21, a receptacle or, in a general manner, an anchoring device (not shown), is provided to receive the anode 18. The anode 18 may be fitted later, for example just before the wall 17 is sealed. At the outlet 28, the fixed support 25 is fixed to a mounting ring 29 for example by screws. The ring 29 may comprise a groove for a ring type joint in order to assure sealing.

Nevertheless, in a preferred manner, said sealing will be achieved in three complementary manners. FIG. 4 shows the first two complementary manners to achieve said sealing.

Firstly, when the shaft 21 rotates, the pressure of the liquid alloy increases. The alloy tends to escape from the chamber 26 and to contaminate the enclosure of the tube. In this case, to confine it within the chamber 26, the invention provides to equip the surface of the ring 29, which is in contact and that of the shaft 21 in the region directly in line with the ring 29, with grooves.

These grooves give the liquid alloy a fluid dynamics character, thereby enabling the sealing. The pressure of the liquid alloy in the grooves increases the mass of metallic liquid that is going to undergo the centrifugal force. This makes it possible to return the metallic liquid towards the centre of the anode.

In a preferred embodiment, these grooves are in the shape of a helix relief. They can also have a spiral shape. The pitch of the helix is oriented so that, for a given direction of rotation of the shaft 21, the helix relief behaves like a scraper in front of the surface that rotates before it. Such a scraper tends to push the alloy towards the chamber 26.

Secondly, for the vacuum tightness, when the anode shaft is not rotating, a space between an interior diameter of the ring 29 and an exterior diameter of the shaft 21 at the point directly in line with this ring 29 is limited. The limit of this space is fixed by the surface tension of the alloy of liquid gallium, indium, tin metal on the material of the shaft 21 and the ring 29. It appears that this alloy is not very wetting and that this surface tension enables a clearance of around one hundredth of a millimeter, conducive to a good rotation of the shaft 21 and moreover easy to meet industrially. The ring 29 is intended to be fixed when the shaft 21 rotates.

The grooves are formed both on the surface of the ring 29 and on that of the shaft 21, enabling a double sided joint to be obtained. This double sided joint makes it possible to obtain, when the anode shaft is not rotating, two spaces 30 and 31 limited between an interior diameter of the ring 29 and an exterior diameter of the shaft 21 at the point directly in line with this ring 29. The fact of forming grooves on the surface of the ring 29 and on that of the shaft 21 improves the robustness of the sealing. Indeed, the efficiency of the joint is inversely proportional to the square of each space 30 and 31. The advantage of this configuration, as illustrated in FIG. 4, is to cumulate the effect of the grooves on the two faces of the joint by increasing the surface area of the grooves. This enables the efficiency of the joint to be improved.

However, with uniquely FIG. 4, the sealing of the joint is not optimal. Indeed, any variation in the spaces 30 and 31 leads to a loss of efficiency of the sealing that can lead to leaks of the liquid alloy in the enclosure of the tube or friction. To overcome this disadvantage, the invention uses a floating ring capable of stabilizing the pressure and the variation in the two spaces 30 and 31. This is illustrated in FIG. 5.

FIG. 5 shows the three complementary manners to achieve this sealing. To achieve this third complementary manner, the invention provides to separate the ring 29 from the axis of rotation or the shaft 21 to have a floating ring. The degree of freedom obtained enables a translation of the ring in the axial direction.

When the shaft 21 rotates, the ring will be locked by one or several longitudinal cotters 32. The cotter 32 is a part introduced in the axial direction between the shaft 21 and the ring 29 to prevent any rotation between these two elements. This degree of freedom obtained and the locking by the cotter 32 of the ring 29 enables the movement of the ring and the effect of the grooves to be assured.

Figure 6:
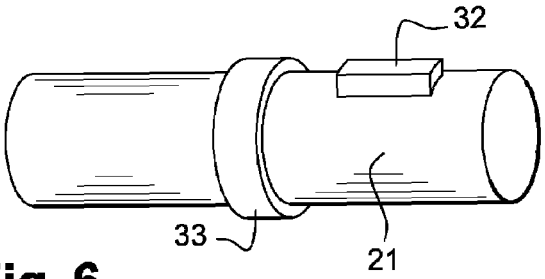
FIG. 6: a schematic representation of a breakdown of the shaft and the ring comprising the sophisticated means of the invention.

FIG. 6 shows in an exploded manner the shaft 21 and the ring 29. The shaft 21 comprises the cotter 32. The cotter 32 is an assembly component enabling the shaft 21 and the ring 29 to be made integral in rotation. This cotter 32 may be a metal dowel pin. The shaft 21 comprises an annular part 33 capable of assuring the fastening and the tightening of the ring 29 to the shaft 21, during the rotation.

Figure 7:
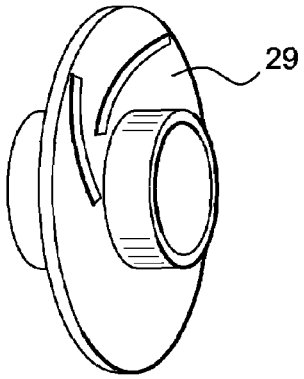
FIG. 7 is a graph that illustrates the simulation results of the loss of power and the back pressure as a function of the space between the ring and the shaft as set forth in an embodiment of the invention.
Figure 7:
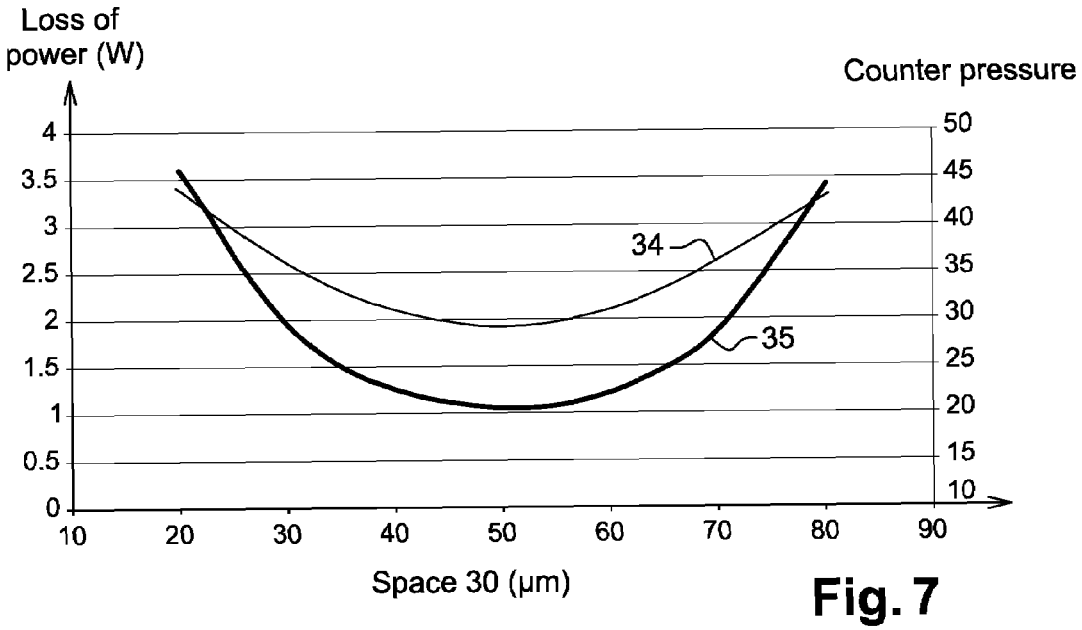

FIG. 7 shows, in a graph, a simulation of the robustness of the sealing of such a joint formed as set forth in the invention. The X-axis represents one of two spaces in μm. In the example of FIG. 7, the space analyzed is the space 30, knowing that the space 31 will have the same results and characteristics. The right hand Y-axis represents the back pressure generated by the grooves compared to the pressure produced by the rotation of the shaft. The back pressure is the pressure created by the grooves to bring the liquid alloy back to the centre of the anode. The left hand Y-axis represents the loss of power in watts. The loss of power is due to the shearing of the liquid alloy.

Curve 34 represents the loss of power in relation to variations in the limited space 30. Curve 35 represents the back pressure generated by the grooves, when the shaft is rotated.

Defects of the ring due to an unbalanced rotation or a misalignment or a circularity defect of the ring are represented in FIG. 7 by assigning the values 20 μm to 80 μm to the space 30. To have a balance in the two spaces, the values 80 μm to 20 μm are assigned to the space 31.

The analysis of the curves 34 and 35 is firstly made in the case where the ring is fixed to the shaft then in the case where the ring is floating. In the case where the ring is firmly connected to the shaft, as illustrated in FIG. 4, the two spaces have preferably the same dimensions. They are, in the example of FIG. 7, 50 μm on both sides.

Curve 35 shows that the efficiency of the joint increases with the defect. Indeed, the back pressure generated to bring the liquid alloy back towards the interior increases. As a result, the double sided joint with a fixed ring is robust by design. The back pressure depends on the dimensions of the two spaces. The more symmetrical these dimensions, the more the efficiency of the joint increases. Thus, the best practice for manufacturing the joint is to assure a symmetrical configuration of the two spaces.

However, the curve 34 shows that with a fixed ring the losses of power increase with the defect. This leads to each defect or movement of the fixed ring increasing the losses of power. This increase creates an additional energy in the joint. This brings about the creation of counter-charge to return to a more stable state.

In the case where the ring is floating, as illustrated in FIG. 5, the two spaces may not have the same dimensions. For the same reasons as previously, to attain a more stable configuration, in other words symmetrical, the dimensions of the two spaces are modulated as a function of each other. This makes it possible to obtain an automatically centering joint. When the ring is floating, the risk of friction is eliminated. The efficiency of the joint with this type of configuration is the same as in the case where the ring is fixed with a symmetrical configuration. Indeed, the efficiency of the joint is determined according to the back pressure that the grooves are capable of generating in the fluid. And since the surface area of the grooves is the same in FIG. 4 and FIG. 5, the level of efficiency does not change.

With this floating ring, the stabilization of the two spaces takes place in an automatic and natural manner. This enables the creation of less additional heat due to less loss of power, compared to the example of FIG. 4. This joint obtained is more robust than the joint obtained with FIG. 4. Moreover, it is very easy to manufacture.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

The invention claimed is:

1. An X-ray tube, comprising:

an enclosure; and in the enclosure, a cathode, an anode situated opposite the cathode and rotating on a shaft, and a fixed anode shaft support, wherein the fixed anode shaft support comprises a chamber, wherein the shaft of the anode is maintained in the chamber, wherein the fixed anode shaft support is in the form of a removable cartridge, wherein the chamber of the support is filled with an alloy, wherein the chamber is equipped with a sealing joint at the shaft outlet to prevent the alloy leaking outside of the chamber, wherein the fixed anode shaft support comprises, at the position of an outlet of the anode shaft outside of the fixed anode shaft support, a surface of a ring in contact with a surface attached to the shaft, wherein the surface of the ring and the surface of the shaft in the region directly in line with the ring comprise grooves, enabling a double sided joint to be obtained, and wherein the fixed anode shaft support comprises, at the location of the two surfaces, two spaces narrower than a natural flow clearance of the alloy due to the surface tension of the alloy.

2. The X-ray tube of claim 1, wherein the two spaces are symmetrical.

3. The X-ray tube of claim 2, wherein the symmetry of these two spaces is assured, during the design of the tube, when the ring is fixed to the anode shaft.

4. The X-ray tube of claim 2, wherein the symmetry of these two spaces is obtained when the ring is separated from the anode shaft to achieve a floating ring.

5. The X-ray tube of claim 4, wherein the shaft comprises at least one longitudinal cotter (32) configured to lock the floating ring to the shaft when the anode rotates.

6. The X-ray tube of claim 5, wherein the longitudinal cotter is a metal dowel pin.

7. The X-ray tube of claim 4, wherein the shaft comprises an annular part configured to reinforce the locking of the floating ring to the anode shaft.

8. The X-ray tube of claim 1, wherein the grooves behave like a scraper such that the grooves push the alloy back towards the chamber when the anode rotates.

9. The X-ray tube of claim 1, wherein the alloy is a gallium, indium or tin alloy.

10. The X-ray tube of claim 1, wherein the support comprises bearings.

* * * * *

UNITED STATES PATENT AND TRADEMARK OFFICE

CERTIFICATE OF CORRECTION

PATENT NO. : 7,672,434 B2
APPLICATION NO. : 12/248057
DATED : March 2, 2010
INVENTOR(S) : Saint-Martin et al.

It is certified that error appears in the above-identified patent and that said Letters Patent is hereby corrected as shown below:

On the Title Page, below Item (65), in Column 1, insert -- (30) Foreign Application Priority Data: Oct. 12, 2007 (FR) .....0758261 --.

Signed and Sealed this

Fifteenth Day of June, 2010

David J. Kappos

David J. Kappos
*Director of the United States Patent and Trademark Office*